US007254358B2

(12) United States Patent
Hamada et al.

(10) Patent No.: US 7,254,358 B2
(45) Date of Patent: Aug. 7, 2007

(54) COLOR IMAGE FORMING APPARATUS

(75) Inventors: Shuta Hamada, deceased, late of Hachioji (JP); by Akira Hamada, legal representative, Hyogo (JP); by Yoshiko Hamada, legal representative, Hyogo (JP); Takenobu Kimura, Hachioji (JP); Yotaro Sato, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 196 days.

(21) Appl. No.: 11/183,596

(22) Filed: Jul. 18, 2005

(65) Prior Publication Data

US 2006/0093408 A1 May 4, 2006

(30) Foreign Application Priority Data

Nov. 4, 2004 (JP) ..... 2004-320314

(51) Int. Cl.
*G03G 15/16* (2006.01)

(52) U.S. Cl. ..... 399/296; 399/302

(58) Field of Classification Search ..... 399/302, 399/308, 313, 296
See application file for complete search history.

(56) References Cited

U.S. PATENT DOCUMENTS 6,895,204 B2 * 5/2005 Shin ..... 399/296
2003/0123910 A1 * 7/2003 Kim et al. ..... 399/296
2006/0171748 A1 * 8/2006 Inui et al. ..... 399/302

FOREIGN PATENT DOCUMENTS

| | | |
|---|---|---|
| JP | 10-274892 | 10/1998 |
| JP | 11-143255 | 5/1999 |
| JP | 2003-057959 | 2/2003 |

* cited by examiner

*Primary Examiner*—Susan Lee
(74) *Attorney, Agent, or Firm*—Cantor Colburn LLP

(57) ABSTRACT

A color image forming apparatus includes plural developing units that respectively form toner images of different colors on plural photoreceptors, plural primary transferring devices that successively transfer each of the toner images of the plural photoreceptors onto an intermediate transfer belt, which holds a color toner image transferred and superimposed by primary transfer, a secondary transferring device that transfers concurrently the color toner image onto a transfer material, a drive roller that drives the intermediate transfer belt and that is placed between one of the plurality of primary transferring devices which is arranged on the most downstream side in the direction of movement of the intermediate transfer belt and the secondary transferring device, and a controller that controls a discharger discharging the color toner image and the drive of the drive roller.

3 Claims, 2 Drawing Sheets

COLOR IMAGE FORMING APPARATUS

This application claims priority from Japanese Patent Application No. 2004-320314 filed on Nov. 4, 2004, which is incorporated hereinto by reference.

BACKGROUND OF THE INVENTION

The present invention relates to a color image forming apparatus of the electro-photographic method such as a copying machine, printer, facsimile, etc., and in particular to a color image forming apparatus that utilize an intermediate image transfer belt.

Conventionally, a color image forming apparatus of the electro-photographic method utilizing an intermediate image transfer belt has been known in which the toner images of respective colors formed on the photoreceptors for different colors are transferred and superimposed onto the intermediate image transfer belt to form a color toner image, and the color toner image on the intermediate image transfer belt is transferred onto a transfer material such as transfer paper, etc. In other words, after the toner images that have been formed on the photoreceptors and that have been charged electrically with a specific polarity are transferred onto an intermediate image transfer belt by the use of electrostatic force, a color toner image on the intermediate image transfer belt is transferred onto a transfer material using electrostatic force.

Such a color image forming apparatus using an intermediate image transfer belt is used widely as a color image forming apparatus because the toner images formed on the photoreceptors for different colors are transferred successively onto an intermediate image transfer belt by superimposing one toner image on another, and further, because it is possible to transfer a color toner image superimposed on one another in one operation onto a transfer material.

In such a color image forming apparatus, even though the secondary transfer characteristics are good for the toner image of only single color, defects occur in the secondary transfer of multiple color toner images and hence it is difficult to obtain images of high quality. This is because the toner images formed on the intermediate image transfer belt have a wide range of adhered quantity from one layer up to a maximum of four layers, and hence the optimum conditions for secondary transfer according to the respective adhered quantities get shifted.

In view of this, methods have been proposed for improving the secondary transfer characteristics corresponding to the toner adhesion quantities of a wide range by providing a drive roller for driving the belt, providing an electric discharging unit before secondary transfer opposite to the drive roller and via the belt, and making uniform the potential of the color toner image on the intermediate image transfer belt (see, for example, Patent Document 1, Patent Document 2, and Patent Document 3).

Patent Document 1: Japanese Unexamined Patent Application Laid Open No. Hei 10-274892

Patent Document 2: Japanese Unexamined Patent Application Laid Open No. Hei 11-143255

Patent Document 3: Japanese Unexamined Patent Application Laid Open No. 2003-57959

However, although it is possible to improve to some extent the secondary transfer characteristics by making the potential of the toner image uniform, if the discharging unit is made to operate image force is generated between the intermediate image transfer belt and the drive roller there by making them get adhered to each other and the image quality decreases due to the load fluctuations generated by the drive of the belt.

In other words, although the slipping of the belt is suppressed while this adhesion force is operating thereby making it possible to drive the belt with a high accuracy, there was the problem that slight slipping of the intermediate image transfer belt is generated when the discharging unit is made ON/OFF during the image formation operations, thereby causing speed fluctuations due to load variations generated by the belt drive, and hence causing these to appear as image striations on the transfer material.

SUMMARY OF THE INVENTION

An object of the present invention is to provide a color image forming apparatus that prevents the above problems from occurring at the time of image transfer and that makes it possible to carry out stable image formation.

A color image forming apparatus according to the present invention that forms a color image is constituted by a plurality of photoreceptors that hold respectively the toner images of different colors, a plurality of developing devices that respectively form the toner images of different colors of the plurality of photoreceptors, a plurality of primary transferring devices that successively transfer each of the toner images of the plurality of photoreceptors onto an intermediate transfer belt, the intermediate transfer belt that holds a color toner image transferred onto it by primary transfer so as to superimpose one image on the other, a secondary transferring device that transfers the color toner image in one operation onto a transfer material, a drive roller that drives the intermediate transfer belt and that is placed between one of the plurality of primary transferring devices which is arranged on the most downstream side in the direction of movement of the intermediate image transfer belt and the secondary transferring device, and inside the intermediate image transfer belt, an electrostatic discharging unit that discharges the electric charge on the color toner image on the intermediate transfer belt and that is placed opposite to the drive roller, and a controller that controls the discharger and the drive of the drive roller, wherein the controller operates the discharger at least from the time of starting primary transfer until the time of ending the secondary transfer.

Because of operating the discharger at least from the time of starting primary transfer until the time of ending the secondary transfer, the slipping of the belt is eliminated thus achieving stable transfer processing, and hence it is possible to improve the image quality.

DETAILED DESCRIPTION OF THE PREFERRED EMBODIMENT

To begin with, a color image forming apparatus provided with a fixing apparatus according to the present invention is described below.

The technical scope of the present invention shall not be construed to be limited by the terminology used in the present patent specification for the explanation of the preferred embodiment of the present invention.

Figure 1:
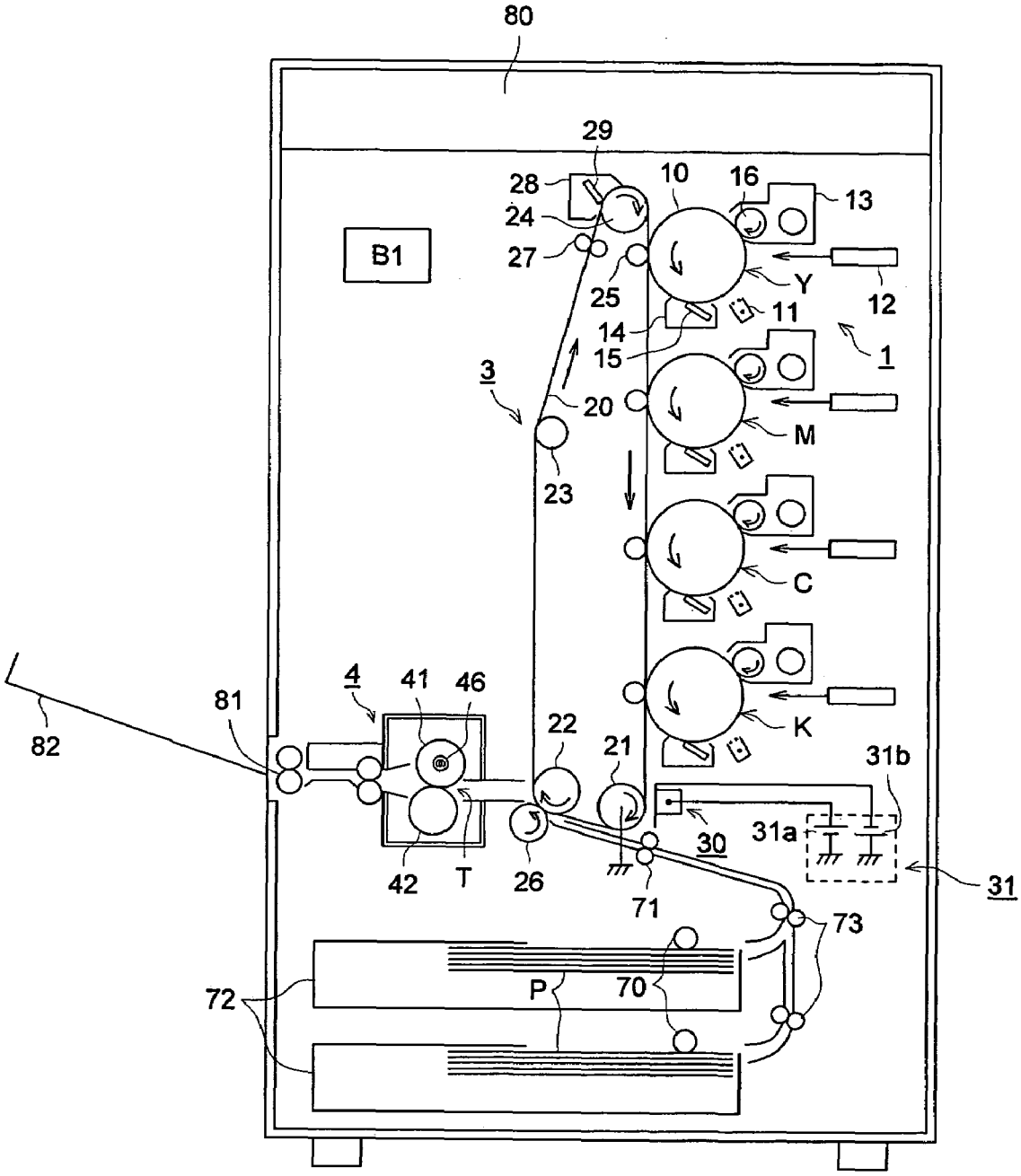
FIG. 1 is a schematic diagram showing an example of the overall configuration of a color image forming apparatus.

FIG. 1 is a schematic diagram showing an example of the overall configuration of a color image forming apparatus.

In FIG. 1, the reference 10 is the photoreceptor, 11 is the scorotron electrical charging unit which is the charging unit according to the present invention, 12 is the writing unit that writes the image on the photoreceptor 10, 13 is the developing unit, 14 is the cleaning unit that cleans the surface of the photoreceptor 10, 15 is the cleaning blade, 16 is the developing sleeve, and 20 is the intermediate image transfer belt. The image forming section 1 is constituted by the photoreceptor 10, the scorotron electrical charging unit 11, the developing unit 13, and the cleaning unit 14, and since the mechanical configuration of the image forming section 1 for each color is the same as each other, the reference numbers have been assigned only for the configuration of the Y (yellow) system in FIG. 1 and the assignment of reference numbers have been omitted for the configuration elements corresponding to the colors M (magenta), C (cyan), and K (black).

The placement of image forming sections 1 for each color are in the sequence of Y, M, C, and K along the direction of movement of the intermediate image transfer belt 20, and the plurality of photoreceptors 10 for the different colors contact the tensioned surface of the intermediate image transfer belt 20, and rotate in the same direction and with the same linear speed at the point of contact as the intermediate image transfer belt 20.

The intermediate transfer belt 20 is entrained about the drive roller 21, the grounding roller 22, the tension roller 23, the discharging roller 27, and the follower roller 24, and the belt unit 3 is constituted by these rollers as well the intermediate transfer belt 20, the primary transferring roller 25, the cleaning unit 28, etc.

The movement of the intermediate transfer belt 20 is carried out by the rotation of the drive roller 21 driven by a drive motor not shown in the figure.

The drive roller that drives the intermediate transfer belt and that is placed between one of the plurality of primary transferring devices which is arranged on the most downstream side in the direction of movement of the intermediate transfer belt and the secondary transferring device, and a controller that controls a discharger discharging the color toner image and the drive of the drive roller.

Providing a speed difference between the photoreceptors 10 and the intermediate transfer belt 20 (photoreceptor is faster than intermediate transfer belt) and driving the belt using the roller placed between the primary transfer device and the secondary transferring device as the drive roller is advantageous in reducing the speed fluctuations of the belt while making it difficult for the belt to sag.

The photoreceptor 10 is a cylindrical metallic base body made, for example, of aluminum on the outer periphery of which is formed a photosensitive layer such as an amorphous silicon layer or an organic photosensitive material layer, and rotates counterclockwise shown by the arrow in FIG. 1 in the state in which the conductive layer has been grounded.

The electrical signal corresponding to the image data from the reading unit 80 is converted into an optical signal and is exposed onto the photoreceptor 10 by the writing unit 12.

The developing unit 13 has a developing sleeve 16 that is a cylindrical body made of non-magnetic stainless steel or aluminum and which maintains specific spacing relative to the peripheral surface of the photoreceptor 10 and which rotates in a direction opposite to the direction of rotation of the photoreceptor 10 at the closest point between them.

The intermediate transfer belt 20 is an endless belt with a volume specific resistivity of $10^6$ to $10^{12}$ Ω·cm and is a partially conducting seamless belt with a thickness of 0.04 to 0.10 mm made of an engineering plastic such as modified polyimide, thermally hardened polyimide, ethylene-tetrafluoroethylene copolymer, polyfluorovinylidene, nylon alloy, etc., in which a conductive material has been dispersed.

A DC voltage with a polarity (positive polarity in the present preferred embodiment) opposite to the polarity of the toner (negative polarity in the present preferred embodiment) is applied to the transfer roller 25 constituting the primary transferring device, thereby carrying out primary transfer of the toner image formed on the photoreceptor 10 onto the intermediate transfer belt 20.

The numeral 26 denotes the secondary transfer roller constituting the primary transferring device that can come into contact with or get separated from the grounding roller 22, and a voltage with a polarity opposite to that of the toner is applied to this roller, and carries out secondary transfer of the color toner image formed on the intermediate transfer belt 20 onto the transfer material P.

The numeral 28 denotes the cleaning unit and is placed opposite to the follower roller 24 via the intermediate transfer belt 20. After the color toner image is transferred to the transfer material P, the electrical charge on the residual toner on the intermediate transfer belt 20 is made weak by the discharging roller 27 to which is applied an AC voltage superimposed on a DC voltage with a polarity identical to or opposite to that of the toner, and the toner remaining on the peripheral surface is removed by the cleaning blade 29.

The numeral 30 denotes a discharger for discharging the color toner image on the intermediate transfer belt and is provided at a position opposite the driver roller 21 via the intermediate transfer belt 20.

The numeral 70 denotes a paper feed roller, 71 denotes the timing roller, 72 the paper cassette, and 73 the transport roller. The numeral 81 denotes the paper discharge roller that discharges the transfer material P after fixing onto the paper discharge tray 82.

The numeral 4 denotes the fixing unit which is constituted by the heating roller 41 heated by a halogen lamp 46 and the pressure roller 42 that is pressed by a pressing mechanism not shown in the figure, and the transfer material carrying the toner image is gripped by the nip T and fixed by applying pressure to it.

The transfer material P after the fixing has been completed proceeds straight as it is and gets discharged on top of the paper discharge tray 82 by the paper discharge roller 81, or is discharged on top of the paper discharge tray 82 by the paper discharge roller 81 after it is turned upside down by the reversing selection member 92.

The symbol B1 denotes the controller that controls the different driving sections, the image forming process, the discharger according to the present invention as well as the drive roller.

Although the outline of the configuration of the color image forming apparatus according to the present preferred embodiment has been described above, there is the problem that a slight slipping occurs in the intermediate transfer belt 20 before transferring the superimposed color toner images onto the transfer material P if the discharger is switched ON and OFF during the image forming operations in order to make uniform the voltage on the toner image, which causes speed fluctuations in the drive of the belt due to load variations, and this appears as image striations on the transfer material.

Figure 2:
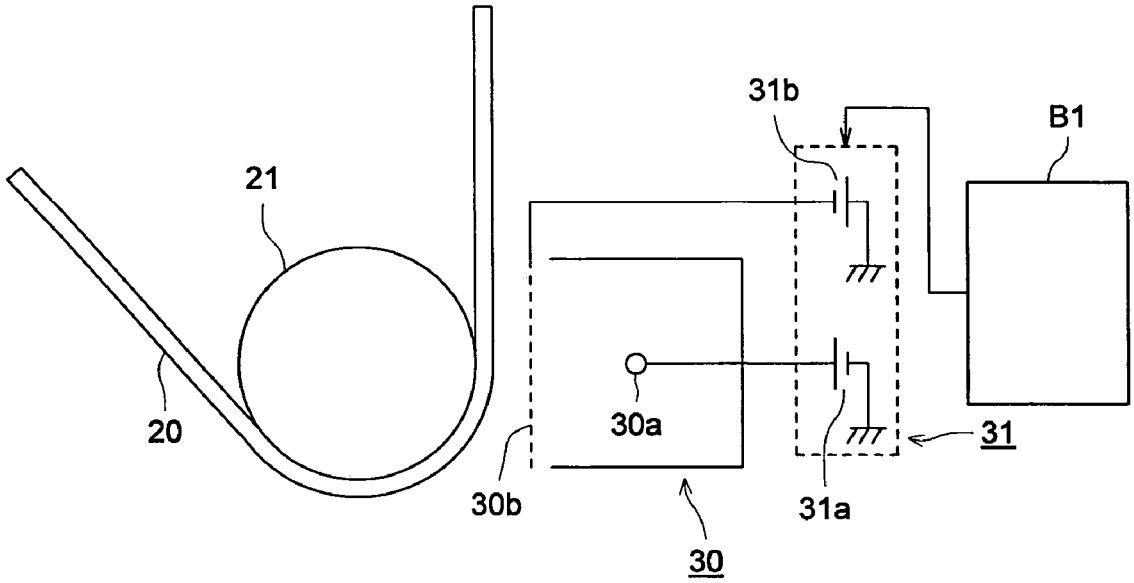
FIG. 2 is an enlarged view of the neighborhood of the discharger and the drive roller in FIG. 1.

FIG. 2 is an enlarged view of the neighborhood of the discharger and the drive roller in FIG. 1.

In order to prevent the above problem, the present invention has the feature that it eliminates the load variations of the belt drive during the processing of the primary transfer and the secondary transfer by providing the discharger 30 at a position opposite the drive roller 21 and operating it at least from the time of starting the primary transfer until the end of the secondary transfer, thereby carrying out control so that stable transfer of color images is done without any uneven image.

Bias voltages with polarities opposite to that of the color toner image are applied to the discharging electrode 30*a* and the control grid 30*b* respectively from the discharge voltage applying apparatus 31*a* for controlling the charging voltage and the grid power supply applying apparatus 31 for controlling the charging voltage both of which being provided in the power supply 31. The magnitude of the bias voltage applied to the discharging electrode 30*a* is in the range of +3 to 5 kV and the magnitude of the bias voltage applied to the control grid 30*b* is in the range of −50 to −300 V.

Further, the discharger 30 can be made to operate before driving the intermediate transfer belt 20, and since the belt gets deteriorated locally at the location where the voltage is applied if a high voltage is continued to be applied while the intermediate transfer belt 20 has stopped, there is the effect of preventing the further deterioration of the intermediate transfer belt 20 if the absolute value of the output voltage of the discharger 30 before driving the belt is made lower than the absolute value of the output voltage after driving the belt.

By the way, in the present preferred embodiment while the voltage applied has been set at 3 to 5 kV when the belt is running, the slip at the time of starting the belt movement is being prevented by reducing this voltage to about 1 to 1.5 kV when the belt has stopped.

What is claimed is:

1. A color image forming apparatus for forming a color image, comprising:

(a) a plurality of photoreceptors each for carrying a toner image having a color different from each other;

(b) a plurality of developing devices each for forming each of the color toner images on each of the plurality of photoreceptors;

(c) a plurality of primary transferring devices each for primary transferring each of the toner images successively onto an intermediate transfer belt;

(d) a intermediate transfer belt for carrying a color toner image which has been primary transferred and superimposed;

(e) a secondary transferring device for secondary transferring concurrently the color toner image onto a transfer material;

(f) a drive roller provided between one of the plurality of primary transferring devices which is arranged on the most downstream side of the intermediate transfer belt in a moving direction thereof and the secondary transferring device, and inside the intermediate transfer belt for driving the intermediate transfer belt;

(g) a discharger provided facing the drive roller for discharging the color toner image on the intermediate transfer belt; and (h) a controller for controlling the discharger and a drive of the drive roller, wherein the controller operates the discharger at least from a start time of the primary transferring to a completion of the secondary transferring.

2. The color image forming apparatus of claim 1, wherein the controller operates the discharger before the intermediate transfer belt rotates.

3. The color image forming apparatus of claim 2, wherein the controller controls so that an absolute value of an output voltage of the discharger before the drive of the intermediate transfer belt is started is made lower than that of the output voltage of the discharger after the drive of the intermediate transfer belt is started.

* * * * *